US005289616A

United States Patent [19]

Taniyama

[11] Patent Number: 5,289,616

[45] Date of Patent: Mar. 1, 1994

[54] HINGE WITH MOTION LIMITING MECHANISM

[76] Inventor: Yoshihiko Taniyama, 9380 Old Southwick Pass, Fulton County Alpharetta, Ga. 30202

[21] Appl. No.: 941,547

[22] Filed: Sep. 8, 1992

[51] Int. Cl.[5] ..... E05D 11/06

[52] U.S. Cl. ..... 16/376; 16/374

[58] Field of Search ..... 16/374, 376

[56] References Cited

U.S. PATENT DOCUMENTS

| | | | |
|---|---|---|---|
| 2,498,557 | 2/1950 | Lantz | 16/374 |
| 4,535,888 | 8/1985 | Nusselder | 206/444 |
| 4,613,044 | 9/1986 | Saito et al. | 206/444 |
| 4,702,369 | 10/1987 | Philosophe | 206/312 |
| 4,750,611 | 6/1988 | Morrone | 206/45.13 |
| 4,793,480 | 12/1988 | Gerlardi et al. | 206/312 |
| 4,817,792 | 4/1989 | Seifert | 206/309 |
| 4,819,799 | 4/1989 | Nomula et al. | 206/310 |
| 4,850,477 | 7/1989 | Gelardi et al. | 206/45.19 |
| 4,865,195 | 2/1989 | Brands | 206/387 |
| 4,874,085 | 10/1989 | Grobecker et al. | 206/309 |
| 4,875,743 | 10/1989 | Geldardi et al. | 312/13 |
| 4,895,252 | 1/1990 | Nomula et al. | 206/310 |
| 4,899,875 | 2/1990 | Herr et al. | 206/313 |
| 4,916,567 | 4/1990 | Grobecker et al. | 360/133 |
| 4,998,618 | 3/1991 | Borgions | 206/307 |
| 5,048,715 | 9/1991 | Wolff | 16/264 |
| 5,050,734 | 9/1991 | Chen | 206/444 |
| 5,101,971 | 4/1992 | Grobecker | 206/232 |

FOREIGN PATENT DOCUMENTS

| | | | |
|---|---|---|---|
| 0420350 | 4/1991 | European Pat. Off. . | |
| 2520305 | 11/1976 | Fed. Rep. of Germany | 16/374 |

*Primary Examiner*—Lowell A. Larson
*Assistant Examiner*—Carmine Cuda
*Attorney, Agent, or Firm*—Troutman Sanders

[57] ABSTRACT

A motion limiting device for hingedly connected storage containers which includes a motion limiting protrusion, an arcuate slot, a rib, and an arcuate groove. The motion limiting protrusion and the rib are abutted and formed in the rear sidewall portion of a first member. The arcuate slot and arcuate groove are correspondingly shaped and formed in the rear sidewall portion of a second member such that the motion limiting protrusion and rib become matingly engaged with the arcuate slot and arcuate groove respectively when the first member and second member are hingedly connected.

8 Claims, 3 Drawing Sheets

HINGE WITH MOTION LIMITING MECHANISM

BACKGROUND OF THE INVENTION

1. Field of Invention

This invention relates to a motion limiting device for a storage container. More specifically, this invention relates to a protrusion mated with an arcuate slot on the rear portion of a storage container, which combine to limit the range of motion of the container.

2. Description of the Prior Act

Storage containers for compact disks, mini-disk cartridges, and the like often consist of a base tray and cover, which are hingedly connected at their rear. In order to alleviate the possibility of an object or material, such as promotional material, a compact disk or a mini-disk cartridge, from falling out of the cover of the storage container when the container is in the open position, motion limiting mechanisms have been incorporated into some containers. A preferred range of motion for the cover of such containers has been found to be 180 degrees from the closed to the open position. If the material or object inserted into the cover becomes dislodged, the 180 degree limitation restricts the article to falling within the container.

An example of one such motion limiting mechanism is a base tray with a rear ledge extending horizontally outward from its bottom such that the rear of the cover rests against the ledge when the container is in the completely open position of 180 degrees. This mechanism is sufficient for limiting the range of motion of the cover to 180 degrees. However, this mechanism usually only works well for squared cornered containers and adds to the length of the container. Further, this motion limiting mechanism is predominantly conducive to only 180 degrees because to vary the range of motion of the cover to other angles would cause the container to have a ledge extending outwardly at different angles from the rear bottom of the base tray. This configuration would likely make the container both more cumbersome and less attractive to the eye.

Another motion limiting mechanism is described in the applicant's application Ser. No. 07/929,276 entitled "Storage Container for Mini-Disk Cartridges" which was filed Aug. 13, 1992. As shown in FIGS. 10–13, this mechanism incorporates an arcuate slot 111' formed below a hinged depression or hole 49' in the inner rear side portion of the base tray 55' with a corresponding motion limiting protrusion 112' in the outer rear side portion of the cover 35'. As shown in FIG. 11, the motion limiting protrusion 112' rests within the arcuate slot 111'. Though not shown, the arcuate slot may also be formed above or on either side of the hinged depression. The arc of the arcuate slot may be enlarged or decreased to adapt to varying ranges of motion such that the range of motion of the cover may vary from within 0 to 360 degrees. FIG. 12 shows the placement of the motion limiting protrusion 112' and arcuate slot 111' when the container's cover has rotated 180 degrees, while FIG. 13 illustrates each when the cover has pivoted approximately 30 degrees from the closed position. Further, unlike the base tray with the bottom rear ledge, this mechanism is hidden within the container such that this configuration is less cumbersome and more pleasing to the eye than the base tray ledge motion limiter. However, as the container is increasingly opened and closed and other external pressures are applied to it, the protrusion occasionally tends to crack or break off.

SUMMARY OF THE INVENTION

Accordingly, it is an object of this invention to provide a motion limiting mechanism for containers or the like which is durable and hidden from the user.

These and other objects are achieved by the motion limiting mechanism of the present invention for a container having a hingedly connected base tray and cover. In one preferred embodiment, the motion limiting mechanism includes an arcuate depression, a motion limiting protrusion, an arcuate groove and a rib. The rib includes two portions; one portion is connected to a hinge protrusion and a second, higher portion is located radially outward from the first portion. The arcuate depression is also comprised of two portions; the first portion is an arcuate groove and the second portion is an arcuate slot. The arcuate slot is formed below a hinged depression or hole in the outer rear side portion of the base tray such that it surrounds a portion of the depression. The arc of the arcuate slot is preferably that of a semicircle such that the range of motion for the cover will be 180 degrees. Though the arcuate slot is preferably formed below the hinge depression, the slot may also be formed above or on either side of the depression.

An arcuate groove complimentary in shape to the arcuate slot is also formed between the arcuate slot and the hinge depression. Since the arcuate groove is formed closer to the hinge depression than the arcuate slot, the groove has a slightly smaller arc the slot. However, the groove starts and finishes at the same horizontal points as the slot relative to the hinge depression. Further, the depth of the groove is preferably more shallow than the depth of the slot.

A complimentary motion limiting protrusion having a diameter approximately the width of the arcuate slot is formed on the inner rear side portion of the cover next to a hinge protrusion. The motion limiting protrusion is preferably formed between the hinge protrusion and the rear edge of the cover. The spacing between the hinge protrusion and motion limiting protrusion are such that they are comfortably and securely engagable with the hinge depression and arcuate slot respectively when the base tray and cover are hingedly mated. Though the motion limiting protrusion is preferably formed between the hinge protrusion and rear edge of the cover, the motion limiting protrusion may be formed anywhere in the vicinity of the hinge protrusion as long as the protrusions maintain the same spacing. By varying the position of the motion limiting protrusion, varying ranges of motion may be created without repositioning the arcuate slot.

In the preferred embodiment, the motion limiting protrusion has rounded edges on its top. However, in other embodiments it may have squared edges or be triangular, as well as taking the form of any shape that is able to rotate within the arcuate slot. In varying the dimensions and shape of the motion limiting protrusion, the arcuate slot should be correspondingly reshaped to adapt to the motion limiting protrusion.

A rib having a length the distance between the motion limiting protrusion and the hinge protrusion is also formed on the inner rear side portion of the cover such that it extends to both protrusions. The rib provides a connection between both protrusions and acts as a reinforcement and strengthener for the motion limiting protrusion. The rib rests in the base tray's arcuate groove when the base tray and cover are matingly engaged. Based on the use of the container, the height and width of the rib may be varied to adapt to the expected stress on the motion limiting mechanism as long as the depth and width of the arcuate groove are correspondingly adjusted. In the preferred embodiment, the rib is substantially rectangular with squared edges. However, in other embodiments the rib may have rounded edges or be ramplike, as well as taking the form of any shape that will provide the necessary reinforcement for the motion limiting protrusion. In varying the dimensions and shape of the rib, the arcuate groove should be correspondingly reshaped to adapt to the rib.

The motion limiting mechanism is operative when the base tray and cover are hingedly connected. When the hinged connection is made, the motion limiting protrusion is secured within the arcuate slot, and the rib rests against the arcuate groove. As the container is opened and closed, the motion limiting protrusion travels along the arcuate slot and limits the motion of the container when it reaches the ends of the arcuate slot. The rib gives added reinforcement to the motion limiting protrusion by dissipating much of the force and stress away from the motion limiting protrusion, therefore, further assuring that the motion limiting protrusion will be less likely to crack or break off.

BRIEF DESCRIPTION OF THE DRAWINGS

The accompanying drawings illustrate several presently preferred but nevertheless illustrative embodiments of the invention, and serve to aid in the explanation of the principles of the invention.

DETAILED DESCRIPTION OF ILLUSTRATIVE EMBODIMENTS

Referring to FIGS. 1, 2, 4, and 5, in a first embodiment of the invention, the motion limiting mechanism is preferably formed of a transparent, plastic material, although the other similar materials may be utilized. It is preferably employed for storage containers having a base tray and a cover (not shown), which are hingedly connected and is utilized to limit the motion of the cover in relation to the base tray. One such hinged connection includes a hinge depression or hole 49 in the base tray's outer rear side walls 55 and a hinge protrusion 40 on the cover's inner rear side wall 35.

Figure 1:
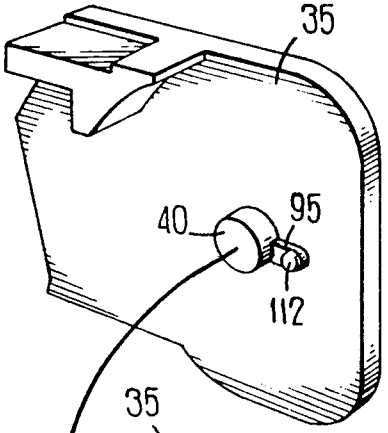
FIG. 1 is an isolated exploded perspective view of a rear side wall of a base tray and a cover with the motion limiting mechanism portions, which include a cylindrical motion limiting protrusion, ready for engagement.
Figure 1:
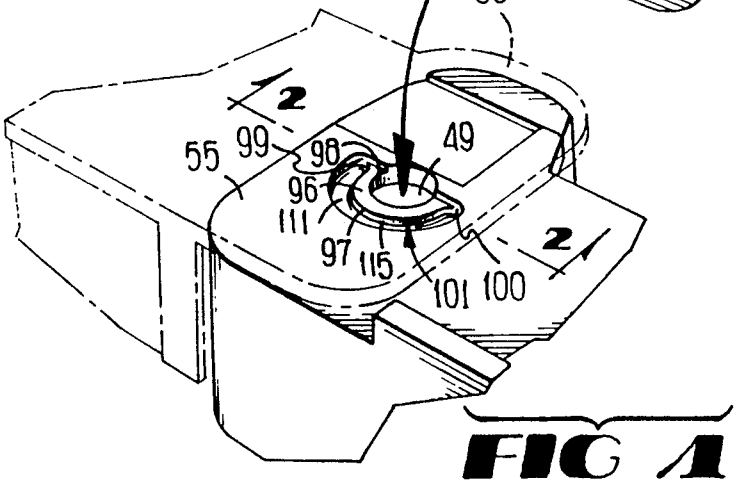

As shown in FIG. 1, the mechanism includes four main components, an arcuate depression 101, a motion limiting protrusion 112, and a rib 95. Arcuate depression 101 comprises two portions; the first portion is arcuate groove 96 and the second portion is arcuate slot 111. According to the uses of the container, the mechanism may be formed in either or both base tray rear side wall 55 and cover rear side wall 35. However, a cover having a portion of the motion limiting mechanism on one of its rear side walls 35 requires the base tray to have the complimentary portion of the mechanism in its corresponding rear side wall 55.

The arcuate slot 111 is preferably formed in one or both of the base tray's outer rear side walls 55 below the base tray's hinge depression 49 such that it surrounds a portion of the depression 49. Preferably the arcuate slot is positioned so that its inner edges 115 are located approximately 1 millimeter away from the hinge depression 49, although other distances between the slot and the depression may be applied for varying container sizes and uses. The arcuate slot 111 preferably extends partially into the base tray's side wall 55, though it may extend fully through the side wall 55. The arc of the arcuate slot 111 is preferably a semi-circle, which allows the range of motion for the cover to be 180 degrees. However, the length of the arcuate slot 112 may be enlarged or decreased for various ranges of motion. Preferably, the width of the slot 111 is approximately 1.4 millimeters, although the width may be enlarged or decreased for varying container sizes and uses. Though the arcuate slot 111 is preferably formed below the hinge depression 49, the slot 111 may also be formed above or on either side of the depression 49.

The arcuate groove 96 is preferably formed to the base tray's outer side rear wall 55. The arcuate groove's outer edge 97 is preferably formed to the arcuate slot's inner edge 115, which is the edge closest to the hinge depression 49, while the groove's inner edge 98 is preferably formed to the hinge depression 49. The arcuate groove 96 has a slightly smaller arc than the arcuate slot 111 since it is essentially formed within the inner edges 115 of the slot 111. Also, preferably, the depth of the arcuate groove 96 is less than the depth of the arcuate slot 111.

The motion limiting protrusion 112 is formed in one or both of the cover's inner rear side walls 35 to conform with the base tray outer rear side walls 55 having arcuate slots 111. The motion limiting protrusion 112 is preferably cylindrical with rounded edges at its top and has a diameter slightly smaller than the width of the arcuate slot 111. The motion limiting protrusion 112 is positioned on the cover's side wall 35 so that it may become matingly engaged with the corresponding base tray arcuate slot 111 when the base tray and cover are hingedly connected. The preferable location for the motion limiting protrusion 112 on the cover's rear side wall 35 is between the hinge protrusion 40 and the rear edge of the cover. However, the motion limiting protrusion 112 may be formed anywhere in the vicinity of the hinge protrusion 40 as long as the protrusions 112 and 40 maintain the same spacing. By varying the position of the motion limiting protrusion 112, various ranges of motions for the container may be adapted for different container sizes and uses.

The rib 95, which is utilized to dissipate much of the stress from the motion limiting protrusion 112, is formed on the cover's inner rear side walls 35 having motion limiting protrusions 112. Further, it is formed to the hinge protrusion 40 and the motion limiting protrusion 112. Endwalls 99 and 100 form the beginning and end of arcuate groove 96 and arcuate slot 111 and limit the range of travel of rib 95 within arcuate groove 96. The rib 95 is preferably box-like with squared edges although it may take the form of other shapes and sizes and may have rounded edges as long as the arcuate groove 96 is correspondingly adapted. It has a width preferably approximately the diameter of the motion limiting protrusion 112, a height approximately half the height of the motion limiting protrusion 112, and a length (as would be expected), the distance between the hinge protrusion 40 and the motion limiting protrusion 112. Though these are the preferred width and height of the rib 95, alternative widths and heights may be utilized to increase or decrease the strength of the motion limiting mechanism based on expected stress to the motion limiting protrusion 112 as long as the depth of the arcuate slot 111 and arcuate groove 96 are correspondingly adapted. However, the height of the motion limiting protrusion 112 should always be taller than the height of the rib 95.

Figure 2:
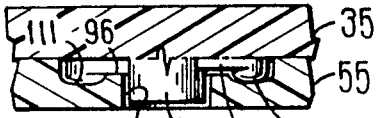
FIG. 2 is an isolated cross-sectional side view of the motion limiting mechanism along line 2—2 in FIG. with the motion limiting protrusion having rounded top edges.
Figure 3:
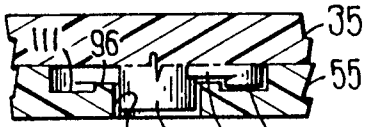
FIG. 3 is an isolated cross-sectional side view of the motion limiting mechanism along line 2—2 in FIG. with the motion limiting protrusion having squared top edges.

As shown in FIG. 2 the base tray and cover are hingedly connected with the hinge protrusion 40 resting within the hinge depression 49. The motion limiting mechanism is created with the motion limiting protrusion 112 with rounded top edges resting within the arcuate slot 111, and the rib 95 resting against the arcuate groove 96. In an alternative embodiment, FIG. 3 shows the motion limiting mechanism with the motion limiting protrusion 112 having squared top edges.

Figure 4:
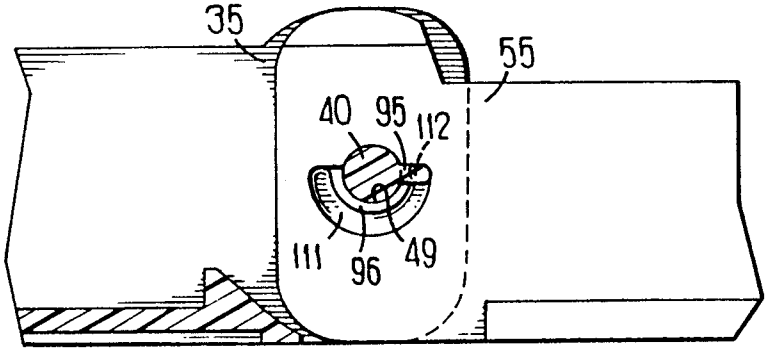
FIG. 4 is an isolated cross-sectional view of the motion limiting mechanism with the motion limiting protrusion in the 180 degrees open position within the arcuate slot.
Figure 5:
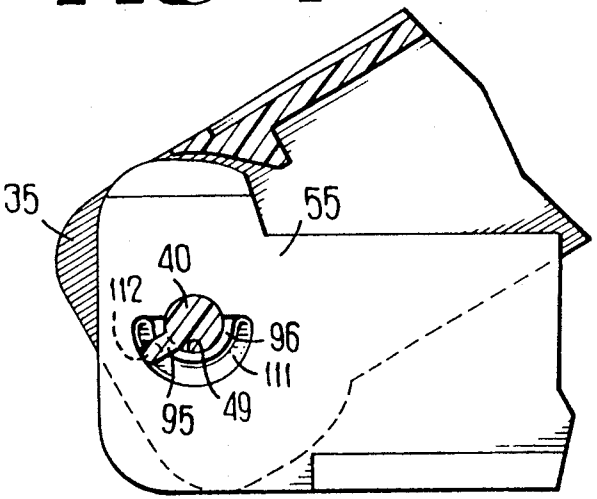
FIG. 5 is an isolated cross-sectional view of the motion limiting mechanism with the motion limiting protrusion in the approximately 30 degree open position within the arcuate slot.

FIG. 4 shows the placement of the motion limiting protrusion 112 and rib 95 within the arcuate slot 111 and arcuate groove 96 respectively when the container's cover has rotated 180 degrees from the closed position to a completely open position. Further, FIG. 5 illustrates the motion limiting protrusion 112 and rib 95 when the cover has pivoted approximately 30 degrees from the closed position.

Figure 6:
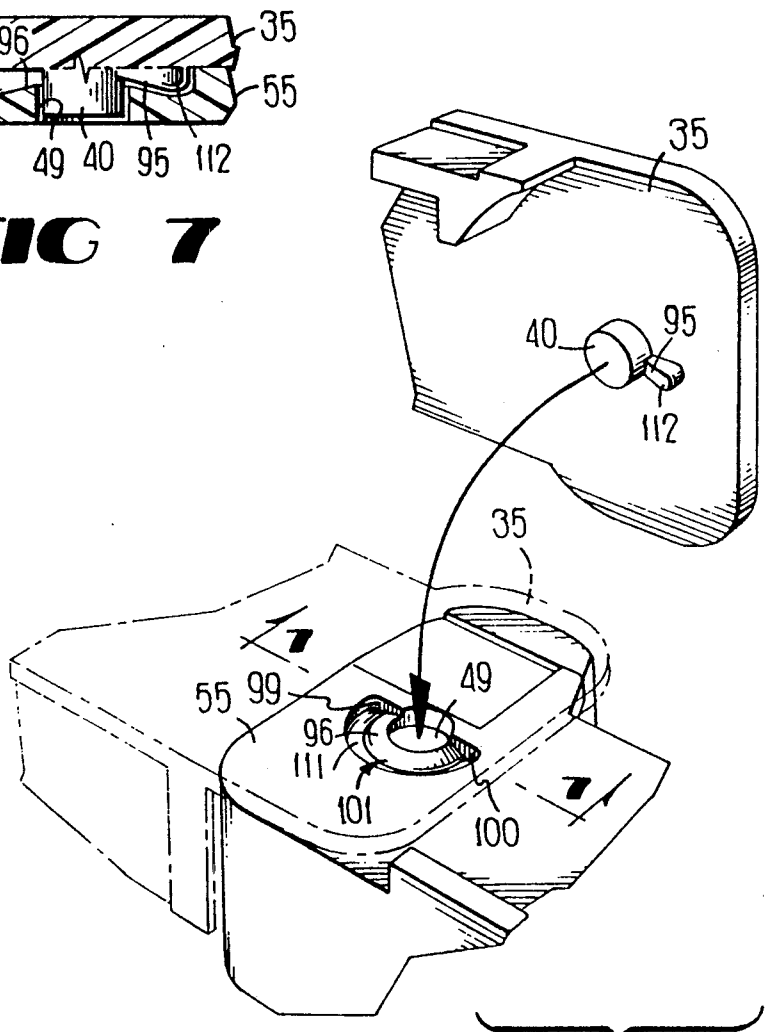
FIG. 6 is an isolated exploded perspective view of a rear side wall of a base tray and a cover with the motion limiting mechanism portions, which include a ramplike motion limiting protrusion and rib, ready for engagement.
Figure 7:
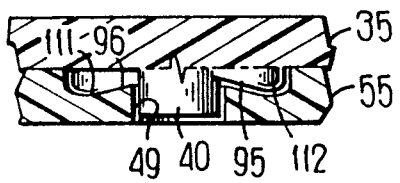
FIG. 7 is an isolated cross-sectional side view of the motion limiting mechanism along line 7—7 in FIG. 6.
Figure 12:
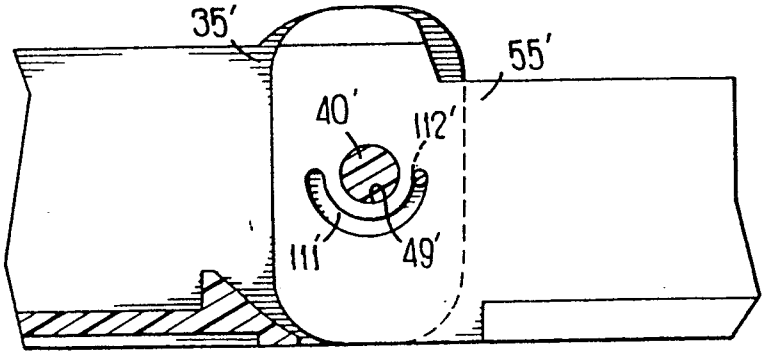
PRIOR ART FIG 12
FIG. 12 is an isolated cross-sectional view of a prior art motion limiting mechanism, without a rib, with the motion limiting protrusion in the 180 degree open position within the arcuate slot.
Figure 13:
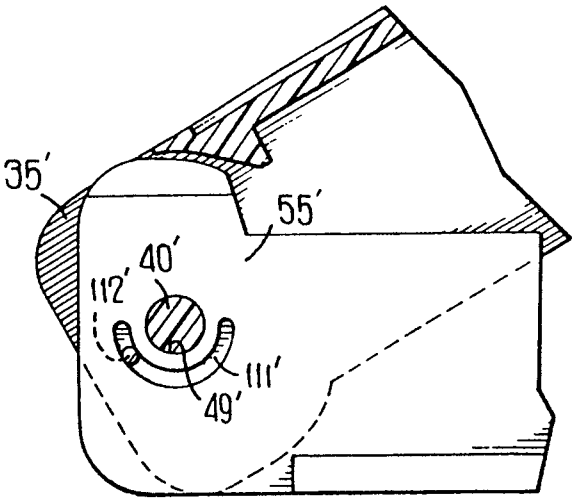
PRIOR ART FIG 13
FIG. 13 is an isolated cross-sectional view of a prior art motion limiting mechanism, without a rib, with the motion limiting protrusion in the approximately 30 degree open position within the arcuate slot.
Figure 10:
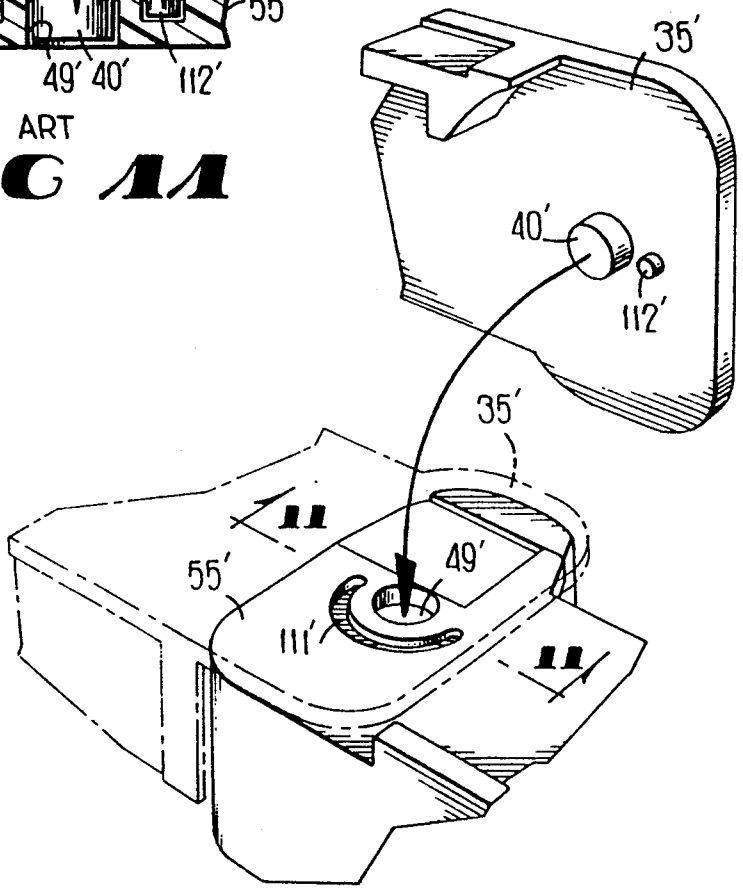
PRIOR ART FIG 10
FIG. 10 is an isolated exploded perspective view of a rear side wall of a base tray and a cover with a prior art motion limiting mechanism, without a rib, ready for engagement.
Figure 11:
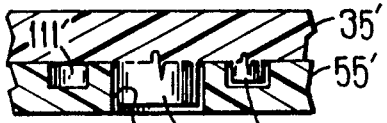
PRIOR ART FIG 11
FIG. 11 is an isolated cross-sectional side view of the motion limiting mechanism along line 11—11 in FIG. 10.

As shown in FIGS. 6 and 7, the motion limiting protrusion 112 and rib 95 may be formed as one component to form a ramp-like structure. This surface area of the rib 95 in contact with the motion limiting protrusion 112 is increased from the preferred embodiment thereby increasing the strength of the motion limiting mechanism. In this embodiment, the arcuate slot 111 and arcuate groove are correspondingly shaped to adapt to the ramplike shape.

Figure 8:
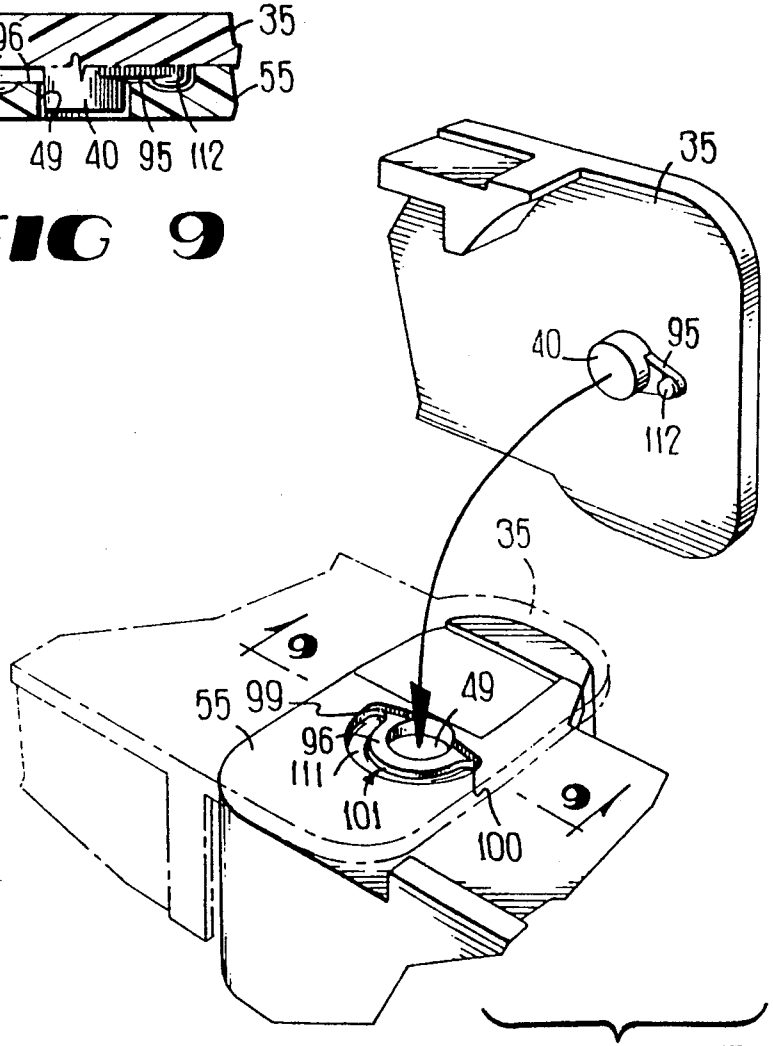
FIG. 8 is an isolated exploded perspective view of a rear side wall of a base tray and a cover with the motion limiting mechanism portions, which include a cylindrical motion limiting protrusion and a tapered rib, ready for engagement.
Figure 9:
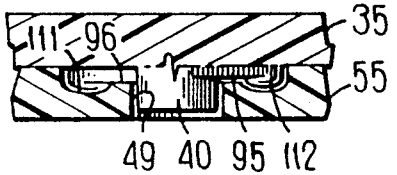
FIG. 9 is an isolated cross-sectional side view of the motion limiting mechanism along line 9—9 in FIG. 8.

As shown in FIGS. 8 and 9, the rib 95 may be wider at the end that touches the hinge protrusion 40 and taper until it meets the motion limiting protrusion 112. The surface area of the rib 95 in contact with the motion limiting protrusion 112 is increased from the preferred embodiment thereby increasing the strength of the motion limiting mechanism. The arcuate groove 96 is correspondingly shaped to adapt to the tapered rib 95.

I claim:

1. A motion limiting mechanism adapted for use with a hinge comprising:

a first member having a first substantially planar surface;

a second member having a second substantially planar surface, wherein said first and second surfaces are disposed parallel and in close proximity to one another;

a hinge for allowing rotational movement between said first and second members, said hinge comprising a circular depression on said first surface and a matingly engagable circular protrusion on said second surface, wherein an axis of rotation of said members is substantially coaxial with said circular depression and perpendicular to said first and second surfaces;

a motion limiting mechanism for limiting rotation between said first and second members, said motion limiting mechanism comprising; a rib on said second surface having a first end connected to said first protrusion and a second end disposed radially outward from said first end, wherein a height of said second end is greater than said first end, and an arcuate depression on said first surface having a radius of curvature centered on said circular depression, having first and second endwalls, said arcuate depression being matingly engagable with said rib allowing said rib to freely move within said depression and between said first and second endwalls whereby relative rotation between said first and second members is limited by an angular dimension of said arcuate depression around said circular depression.

2. The motion limiting mechanism of claim 1, wherein said arcuate depression extends 180 degrees around said circular depression.

3. The motion limiting mechanism of claim 1, wherein a width of said rib decreases with increasing distance from said first end to said second end.

4. The motion limiting mechanism of claim 1 wherein said rib is ramp-like.

5. The motion limiting mechanism of claim 1, wherein;

said rib includes first and second portions, said first portion comprising rib of uniform height and said second portion comprising a motion limiting protrusion extending from said second end of said rib; and said arcuate depression including first and second portions, said first portion being an arcuate groove matingly engagable with said first portion of said rib, said second portion of said arcuate depression being a arcuate slot disposed radially outside of said arcuate groove and matingly enagable with said second portion of said rib.

6. The motion limiting mechanism of claim 5, wherein said arcuate depression extends 180 degrees around said circular depression.

7. The motion limiting mechanism of claim 5, wherein said motion limiting protrusion comprises a cylinder extending perpendicular from said rib.

8. The motion limiting mechanism of claim 5, wherein a width of said rib decreases with increasing distance from said first end to said second end.

* * * * *